US009126412B2

(12) United States Patent
Kamiyama

(10) Patent No.: US 9,126,412 B2
(45) Date of Patent: Sep. 8, 2015

(54) PRINTING DEVICE, AND PRINTING DEVICE MAINTENANCE METHOD

(71) Applicant: SEIKO EPSON CORPORATION, Tokyo (JP)

(72) Inventor: Nobuaki Kamiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/045,142

(22) Filed: Oct. 3, 2013

(65) Prior Publication Data

US 2014/0098146 A1 Apr. 10, 2014

(30) Foreign Application Priority Data

Oct. 10, 2012 (JP) ..... 2012-225277

(51) Int. Cl.
*B41J 2/175* (2006.01)
*B41J 2/165* (2006.01)

(52) U.S. Cl.
CPC ..... *B41J 2/175* (2013.01); *B41J 2/16526* (2013.01)

(58) Field of Classification Search
USPC ..... 347/7, 23, 85, 86, 18, 89, 6, 20
See application file for complete search history.

(56) References Cited

U.S. PATENT DOCUMENTS

| | | | | |
|---|---|---|---|---|
| 5,291,215 | A * | 3/1994 | Nozawa et al. | 347/18 |
| 7,845,777 | B2 * | 12/2010 | Nishida | 347/85 |
| 2010/0157002 | A1 * | 6/2010 | Takada et al. | 347/85 |
| 2013/0113852 | A1 | 5/2013 | Iwata | |
| 2013/0113854 | A1 | 5/2013 | Iwata | |

FOREIGN PATENT DOCUMENTS

| | | | |
|---|---|---|---|
| JP | 2002-038063 | A | 2/2002 |
| JP | 2013-071296 | A | 4/2013 |
| JP | 2013-099861 | A | 5/2013 |
| JP | 2013-099862 | A | 5/2013 |
| JP | 2013-129080 | A | 7/2013 |
| JP | 2013-129081 | A | 7/2013 |

* cited by examiner

*Primary Examiner* — Lam Nguyen
(74) *Attorney, Agent, or Firm* — Global IP Counselors, LLP

(57) ABSTRACT

A printing device includes a first ink reservoir unit configured and arranged to store a first ink having sedimentary properties, a head provided with nozzles, a plurality of first ink supply paths configured and arranged to supply the first ink to the head from the first ink reservoir unit, a stirring unit configured and arranged to stir the first ink existing inside an upstream region in a supply direction of the first ink supply paths, and a control unit configured to execute again an again stirring process after a prescribed time has elapsed from a previous stirring process of the first ink by the stirring unit, and, after execution of that the again stirring process, to eject from the nozzles the first ink that is unstirred existing inside the region further downstream in the supply direction than the upstream region of the first ink supply paths, and inside the head.

7 Claims, 10 Drawing Sheets

PRINTING DEVICE, AND PRINTING DEVICE MAINTENANCE METHOD

CROSS-REFERENCE TO RELATED APPLICATIONS

This application claims priority to Japanese Patent Application No. 2012-225277 filed on Oct. 10, 2012. The entire disclosure of Japanese Patent Application No. 2012-225277 is hereby incorporated herein by reference.

BACKGROUND

1. Technical Field

The present invention relates to a printing device and a printing device maintenance method.

2. Related Art

Known as an example of a printing device is an inkjet printer (hereafter, "printer") which performs printing of images on a medium by discharging ink from nozzles provided on a head toward various types of media such as paper, film or the like. With the printer, ink is supplied to the head via a supply tube from an ink tank that stores ink.

Also, in recent years, in addition to cyan, magenta, and yellow colored inks as well as black ink, various colored inks have been used. For example, with a printer that uses white colored ink (see Japanese Laid-Open Patent Application Publication No. 2002-38063), it is possible to print a color image with good coloring properties by overlaying a white colored background image on a main image using color ink.

SUMMARY

However, when a so-called "sedimentary ink" for which the ink components like the coloring material and the like precipitate easily such as the white colored ink noted above are retained for a long time inside the head in the ink tank or the supply tube, the coloring material precipitates, the ink concentration becomes uneven, and the nozzles become clogged by coloring material that has precipitated and collected. As a result, the problem of the image quality degrading for the printed image, the problem of other colored ink also being ejected wastefully when the head cleaning process is executed to eject sedimentary ink that was retained for a long time and the like occur.

The present invention was created considering these problems, and an object is to inhibit problems due to retention of sedimentary ink.

According to one aspect, a printing device is equipped with a first ink reservoir unit for storing a first ink having sedimentary properties, a first head provided with nozzles for discharging the first ink, a plurality of first ink supply paths for supplying the first ink to the first head from the first ink reservoir unit, a stirring unit for stirring the first ink existing inside the region upstream in the supply direction of the first ink supply paths, and a control unit which is a control unit for executing again an again stirring process of the first ink after a prescribed time has elapsed from a previous stirring process of the first ink by the stirring unit, which after execution of that the again stirring process, ejects from the nozzles the first ink that is unstirred existing inside the region further downstream in the supply direction than the upstream region of the first ink supply paths, and inside the first head.

Other characteristics of the present invention will be made clearer by the notation of this specification and the attached drawings.

BRIEF DESCRIPTION OF THE DRAWINGS

Referring now to the attached drawings which form a part of this original disclosure.

With FIG. 2.

DETAILED DESCRIPTION OF EXEMPLARY EMBODIMENTS

Figure 1:
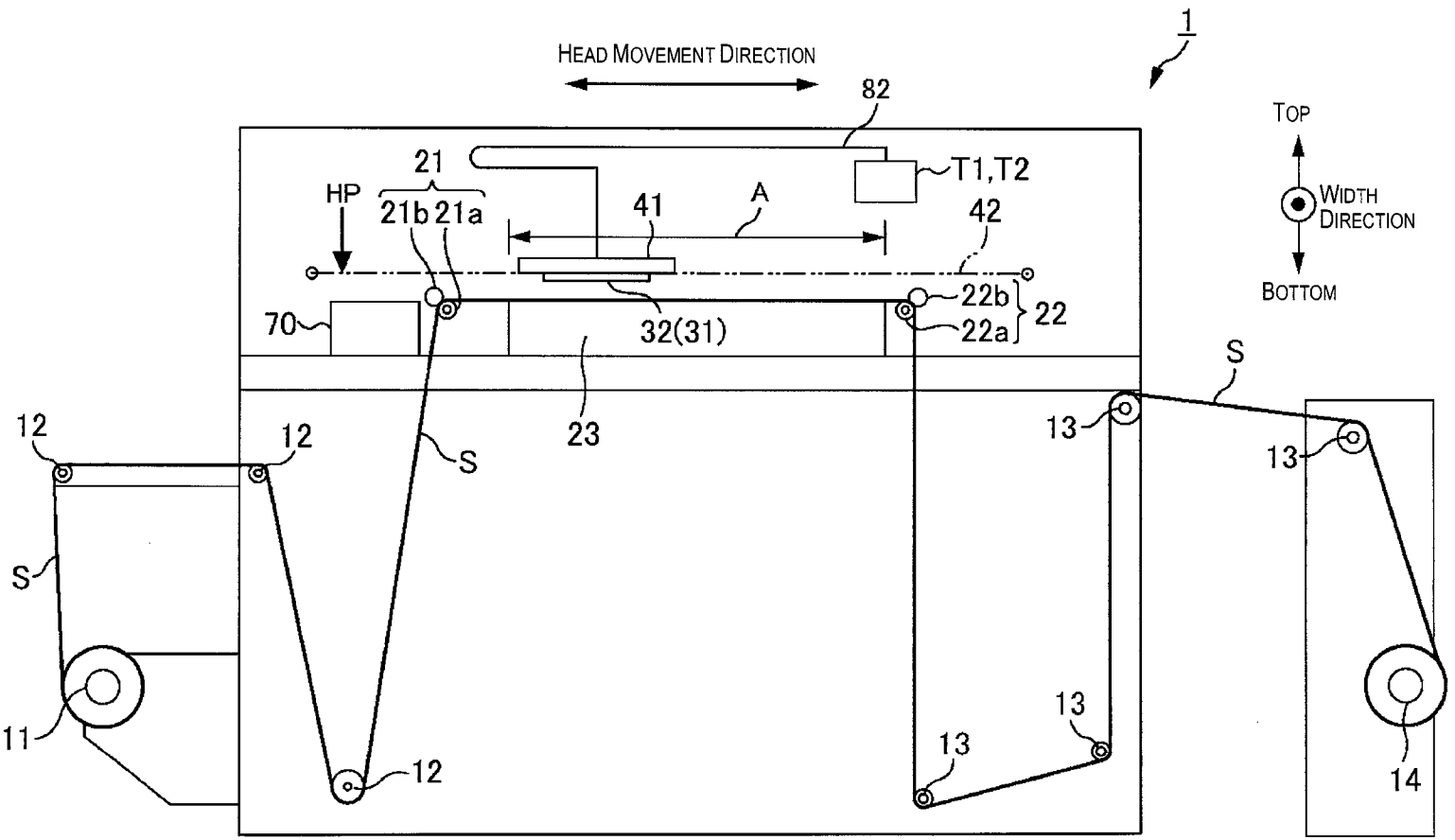
FIG. 1 is a schematic cross section view of the printer.

At least the following is made clear by the notation of this specification and the attached drawings.

A printing device is equipped with a first ink reservoir unit for storing a first ink having sedimentary properties, a first head provided with nozzles for discharging the first ink, a plurality of first ink supply paths for supplying the first ink to the first head from the first ink reservoir unit, a stirring unit for stirring the first ink existing inside the region upstream in the supply direction of the first ink supply paths, and a control unit which is a control unit for executing again an again stirring process of the first ink after a prescribed time has elapsed from an previous stirring process of the first ink by the stirring unit, which after execution of that the again stirring process, ejects from the nozzles the first ink that is unstirred existing inside the region further downstream in the supply direction than the upstream region of the first ink supply paths, and inside the first head.

With this kind of printing device, it is possible to inhibit image quality degradation of the printed image because of problems due to retention of the sedimentary ink, for example uneven ink concentration or clogged nozzles. Also, it is possible to prevent ink for which a problem has not occurred due to retention (specifically, ink that is not sedimentary ink) from being ejected together with unstirred sedimentary ink, and possible to inhibit wasteful ink consumption.

With this printing device, for each nozzle, the first head is equipped with a pressure chamber in communication with that nozzle and filled with the first ink, and a drive element for changing the pressure inside the pressure chamber, and the control unit, using a flushing operation that discharges the first ink from the nozzle by changing the pressure inside the pressure chamber by driving the drive element, ejects the unstirred first ink from the nozzle after execution of the again stirring process.

With this kind of printing device, it is possible to eject unstirred sedimentary ink from the nozzles, and possible to inhibit wasteful ink consumption.

With this printing device, during print job processing, when the prescribed time has elapsed from the previous stirring process of the first ink, the control unit executes the again stirring process of the first ink during that print job processing.

With this kind of printing device, it is possible to more reliably prevent use of sedimentary ink for which problems occur due to retention for printed images, and possible to inhibit image quality degradation of printed images.

With this printing device, when not processing a print job, when the prescribed time has elapsed from the previous stirring process of the first ink, the control unit executes the again stirring process of the first ink before starting the next operation.

With this kind of printing device, when not processing a printing job, even if problems due to retention occur with sedimentary ink, there is no effect on the printed image, so it is possible to reduce wasteful stirring process. Therefore, it is possible to suppress the eject volume of sedimentary ink of the unstirred area.

With this printing device, equipped are a second head on which are provided nozzles for discharging a second ink of a different color from the first ink, a second ink reservoir unit for storing the second ink, and a plurality of second ink supply paths for supplying the second ink to the second head from the second ink reservoir unit, wherein a plurality of the first ink supply paths are connected to the first ink reservoir unit, and a plurality of bypass paths are extended between mutually different first ink supply paths of that plurality of first ink supply paths, and the stirring unit stirs the first ink by circulating the first ink inside a circulation path constituted by the plurality of the first ink supply paths and the plurality of the bypass paths.

With this kind of printing device, it is possible to eliminate sedimentation of sedimentary ink components inside the ink supply paths, and possible to inhibit problems due to retention of sedimentary ink.

With this printing device, equipped are a temporary reservoir unit for storing the first ink supplied from the first ink reservoir unit, and a plurality of branch paths respectively branched from the plurality of first ink supply paths and connected to the temporary reservoir unit, wherein the stirring unit stirs the first ink by returning the first ink inside the temporary reservoir unit to the first ink reservoir unit via the branch paths and the first ink supply paths after the first ink inside the first ink reservoir unit is supplied to the temporary reservoir unit via the first ink supply paths and the branch paths.

With this kind of printing device, it is possible to eliminate sedimentation of sedimentary ink components inside the ink reservoir unit, and possible to inhibit problems due to retention of sedimentary ink.

Also, a maintenance method is provided for a printing device equipped with a first ink reservoir unit for storing a first ink having sedimentary properties, a head provided with nozzles for discharging the first ink, and a plurality of first ink supply paths for supplying the first ink to the head from the first ink reservoir unit. The printing device maintenance method includes steps of executing an again stirring process of stirring the first ink that exists in the region upstream in the supply direction among the first ink supply paths after a prescribed time has elapsed from a previous stirring process, and after executing the again stirring process, ejecting from the nozzles the unstirred first ink that exists inside the region further downstream in the supply direction than the upstream side among the first ink supply paths, and inside the head.

With this kind of printing device maintenance method, it is possible to inhibit image quality degradation of the printed image because of problems due to retention of sedimentary ink, for example, uneven ink concentration or clogged nozzles. Also, it is possible to prevent ink for which problems do not occur due to retention (specifically, ink that is not sedimentary ink) from begin ejected together with unstirred sedimentary ink, and possible to inhibit wasteful ink consumption.

Printing System

We will describe an embodiment with an example of an inkjet printer (hereafter, "printer") as the "printing device," showing an example of a printing system with the printer and a computer connected.

Figure 2A:
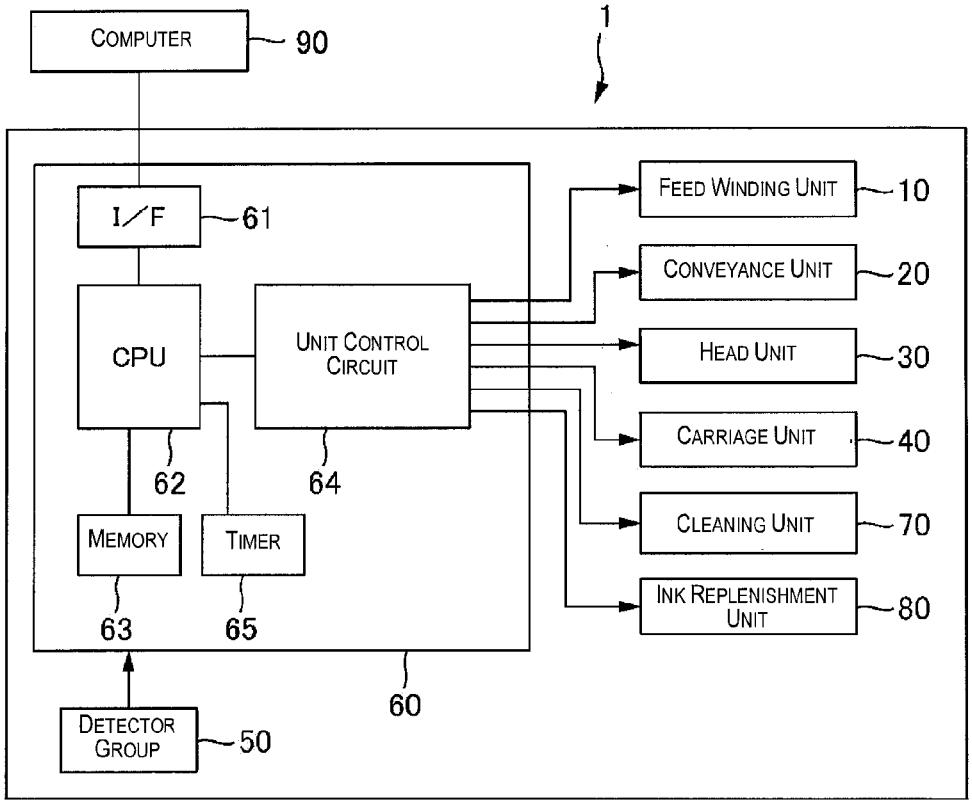
FIG. 2A is a block diagram showing the constitution of the printer.
Figure 2B:
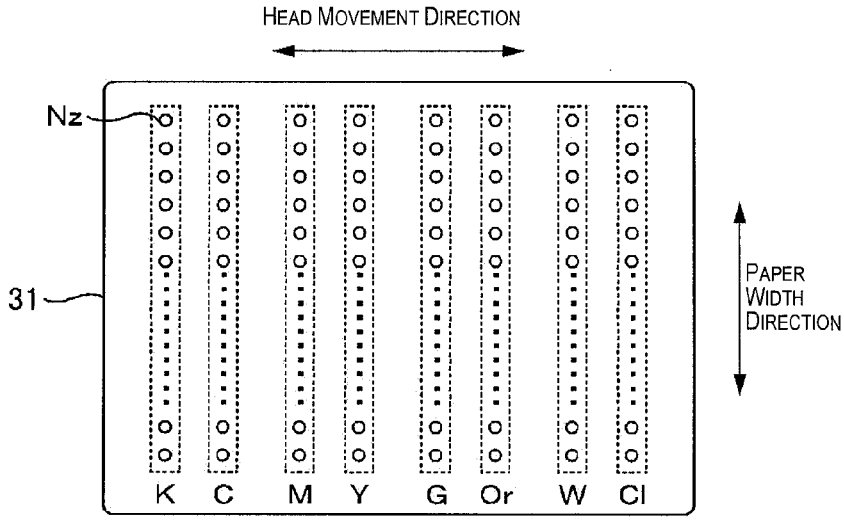
FIG. 2B is a drawing showing the nozzle array provided on the head.

FIG. 1 is a schematic cross section view of a printer 1. FIG. 2A is a block diagram showing the constitution of the printer 1, and FIG. 2B is a drawing showing an array of nozzles Nz provided on a head 31. The printer 1 has a feed winding unit 10, a conveyance unit 20, a head unit 30, a carriage unit 40, a detector group 50, a controller 60, a cleaning unit 70, and an ink replenishment unit 80. The printer 1 is connected to be able to communicate with the computer 90, and the data of the image to be printed by the printer 1 (print job) is sent from the computer 90 to the printer 1. With this embodiment, the medium (medium to be printed) for the printer 1 to print an image on is roll paper S (continuous forms), but this is not limited to that, and can also be a medium such as cut paper, plastic film, fabric or the like.

The controller 60 is an item for performing overall control of the printer 1. An interface unit 61 performs transfer of data with the computer 90 which is an external device. A CPU 62 is an arithmetic processing unit for performing overall control of the printer 1, and controls each unit via a unit control circuit 64. A memory 63 is an item for ensuring an area for storing the programs of the CPU 62, a work area and the like. A timer 65 is an item for counting the elapsed time from the previous stirring process, for example. The detector group 50 is an item that monitors the status inside the printer 1, and is for outputting the detection results to the controller 60.

The feed winding unit 10 has a winding shaft 11 with the roll paper S wound and supported to be able to rotate, an upstream relay roller 12 that winds up the roll paper S fed from the winding shaft 11 and conveys it, a downstream relay roller 13 that winds up the already printed roll paper S and conveys it, and a winding drive shaft 14 supported to be able to rotate that winds the roll paper S.

The conveyance unit 20 has a first conveyance roller 21 that feeds the roll paper S on the conveyance path to a printing area A, a second conveyance roller 22 that sends already printed roll paper S to the printing area A, and a platen 23 with the region of the roll paper S positioned in the printing area A supported from the opposite side (lower side) to the printing surface. The first conveyance roller 21 and the second conveyance roller 22 respectively have drive rollers 21*a* and 22*a* driven by a motor (not illustrated) and driven rollers 21*b* and 22*b* arranged so as to face opposite sandwiching the roll paper S in relation to the drive rollers 21*a* and 22*b*. During the period when an image is being printed on the region of the roll paper S on the printing area A, the conveyance of the roll paper S is temporarily stopped.

The head unit 30 has a plurality of heads 31 that discharge ink toward the region of the roll paper S positioned in the printing area A (on platen 23). As shown in FIG. 2B, a large number of nozzles (openings) Nz that discharge ink are provided on the bottom surface of the head 31, and nozzle rows are formed for each color of ink. The printer 1 of this embodiment can discharge eight colors of ink, and formed on the bottom surface of the head 31 (the nozzle opening surface) are nozzle row K for discharging black ink, nozzle row C for discharging cyan ink, nozzle row M for discharging magenta ink, nozzle row Y for discharging yellow ink, nozzle row G for discharging green ink, nozzle row Or for discharging orange ink, nozzle row W for discharging white ink, and nozzle row C1 for discharging clear ink. With each nozzle row, many nozzles Nz are aligned with a prescribed gap in the paper width direction of the roll paper S.

Figure 4:
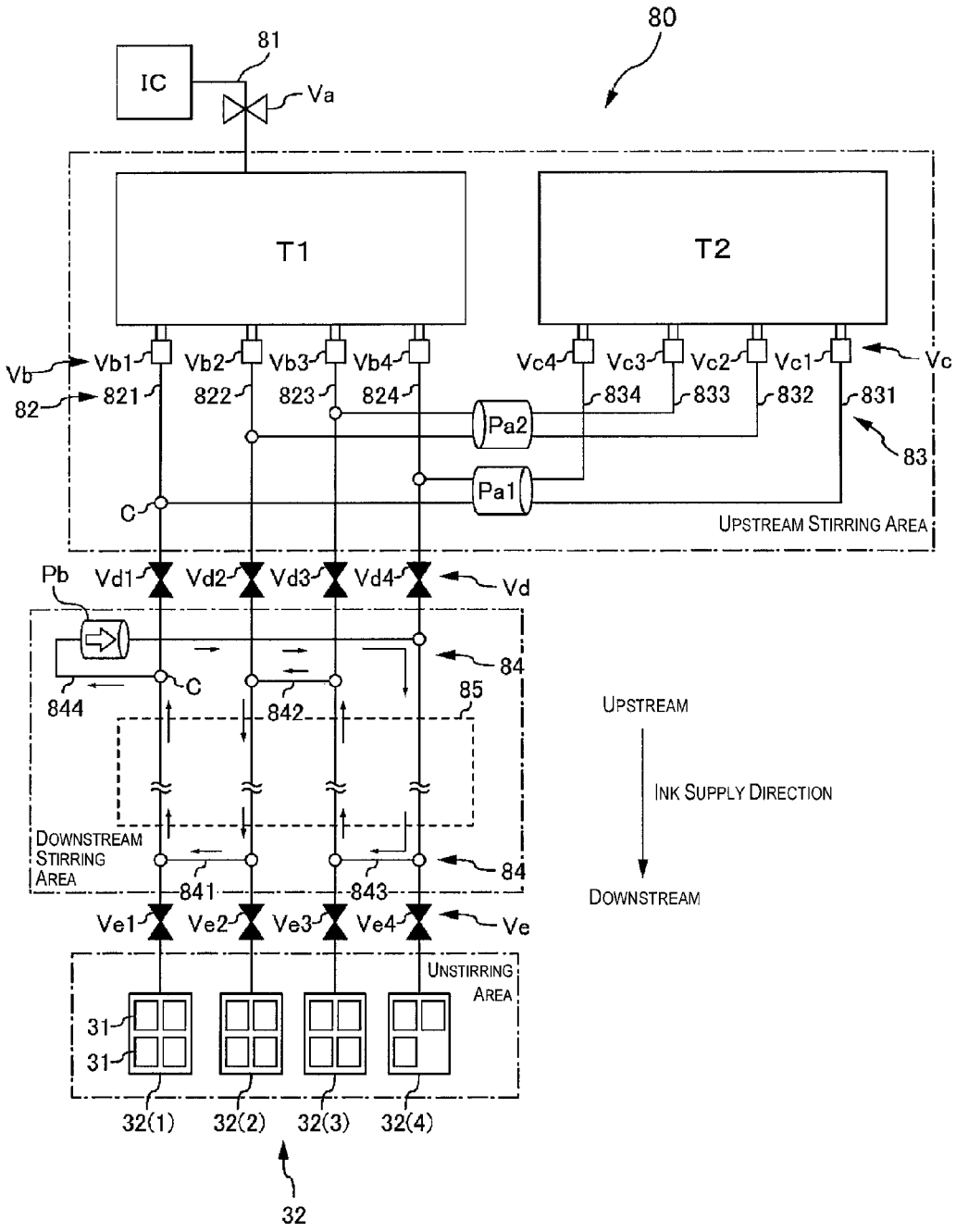
FIG. 4 is an explanatory drawing of the ink replenishment unit of white ink.

Also, the printer of this embodiment has fifteen heads 31, and the fifteen heads 31 are divided into groups of four head groups S32. In specific terms, as shown in FIG. 4 described later, four heads 31 respectively belong to each of a first head group 32 (1), a second head group 32 (2), and a third head group 32 (3), and three heads 31 belong to a fourth head group 32 (4).

The white ink correlates to the "sedimentary ink" (first ink having sedimentary properties)" for which the coloring material precipitates more easily than other color inks. As white ink, examples include ink containing a white colored pigment such as titanium oxide or the like, or ink containing a hollow polymer. By printing a color image or monochromatic image overlapping on a white colored background image using white ink, it is possible to print an image with good coloring properties not affected by other colors of the medium. Also, clear ink is colorless, transparent ink. By coating a color image or monochromatic image with clear ink, it is possible to improve the image glossiness and weather resistance.

A carriage unit 40 is an item for moving the head group 32 placed on a carriage 41. The head group 32 can be moved by the carriage 31 in the conveyance direction (head movement direction shown in FIG. 1) of the roll paper S positioned in printing area A, and can also be moved in the paper width direction that is the orthogonal direction to that. The carriage 41 is divided into four sub-carriages, and one head group 32 is placed on one sub-carriage.

A cleaning unit 70 is an item for testing for ink discharge failure from the nozzles Nz, and cleaning the head 31, and is set at a home position HP (details described later).

The ink replenishing unit 80 is an item for replenishing (supplying) ink to the head 31 when ink is discharged from the head 31 and the ink volume inside the head 31 has decreased (details described later).

With the printer 1 with this kind of constitution, by having the head group 32 discharge ink while it moves in the head movement direction in relation to the region of the roll paper S positioned in the printing area A and also move in the paper width direction, the operation of printing a two dimensional image on the roll paper S and the operation of feeding the region of the already printed roll paper S from the printing area A and conveying the region of the roll paper S before printing to the printing area A are alternately repeated, and an image is continuously printed on the roll paper S. Because of that, the roll paper S is intermittently conveyed by area units corresponding to the printing area A, and images are printed. With the description below, a one time printing of the area unit corresponding to the printing area A is also called one page of printing.

Cleaning Unit 70

Figure 3:
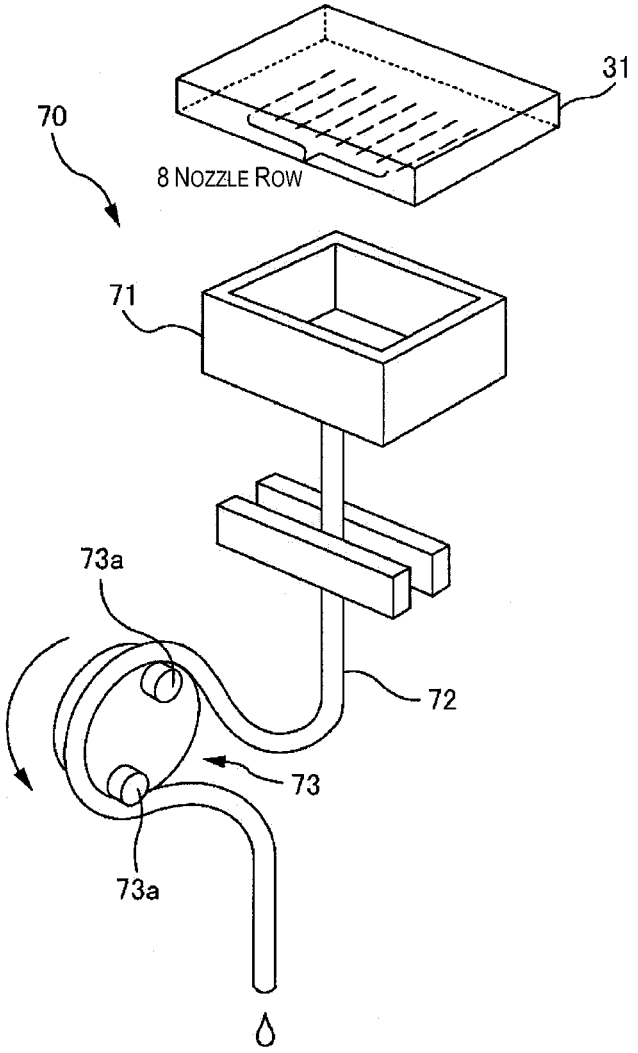
FIG. 3 is an explanatory drawing of a cleaning unit.

FIG. 3 is an explanatory drawing of the cleaning unit 70. When a period continues for which ink is not discharged from the nozzle Nz, there is a risk that the ink will thicken due to evaporation of the ink solvent from the nozzle Nz, or that air bubbles will mix inside the nozzle Nz. If that is the case, discharge failure may occur, such as that a suitable volume of ink may not be discharged from the nozzle Nz, or the ink drops may not land on the correct position. In light of that, the cleaning unit 70 retracts the head group 32 to the home position HP, and executes "defective nozzle testing" that detects a defective nozzle for which discharge failure has occurred, and the "cleaning process" of the head 31 to restore the defective nozzle to a normal nozzle. For that, for each head 31, the head unit 70 has a cap 71, an eject tube 72 connected to the bottom part of the cap 71, a suction pump 73 provided midway in the eject tube 72, and a defective nozzle testing unit (not illustrated). To make the explanation simpler with FIG. 3, the cleaning unit 70 corresponding to one head 31 is shown, but in actuality, each member is provided with fifteen each.

Using the defective nozzle testing unit, the controller 60 performs defective nozzle detection periodically on the fifteen heads 31 or the heads 31 used for printing. The defective nozzle testing is performed in a state with the head 31 facing opposite with a gap toward the cap 71. As the defective nozzle testing method, for example, there is a method of discharging ink drops toward the cap 71 from the nozzle Nz so as to have the ink drops pass through between a light source and an optical sensor, and to detect defective nozzles based on whether or not the light is blocked by the ink drops. Another example is a method by which, in a state with the bottom surface of the head 31 (nozzle opening surface) which is at ground potential and a high electric potential detection electrode provided on the bottom of the cap 71 having a prescribed gap open, electrically conductive ink from the nozzle Nz is discharged toward the detection electrode, and defective nozzles are detected based on the electrical changes that occur with the detection electrode due to the ink discharge from the nozzle Nz. However, the invention is not limited to these methods.

Then, as a result of the defective nozzle testing, when a defective nozzle is detected, the controller 60 executes the head 31 cleaning process. It is also possible to periodically execute the cleaning process, rather than only when a defective nozzle is detected. The head 31 cleaning process is performed in a state with the cap 71 adhered to the bottom surface of the head 31. As shown in FIG. 3, the cap 71 is a box shaped member with the top part open, and when the cap 71 is adhered to the bottom surface of the head 31 (nozzle opening surface), all eight nozzle rows provided on the head 31 are covered by the cap 71, forming an airtight space that is not in communication with the air. In that state, when the suction pump 73 is driven, the airtight space between the head 31 and the suction pump 73 goes to negative pressure, foreign matter (thickened ink, paper dust, air bubbles and the like) are suctioned together with ink from the nozzles Nz of the head 31, and it is possible to restore the defective nozzle to a normal nozzle.

The suction pump 73 has two small rollers 73*a* near its circumference edge part, and the eject tube 72 is wound in the periphery of these two small rollers 73*a*. Then, when the suction pump 73 is driven and rotates in the arrow direction, the air inside the eject tube 72 is pressed by the small rollers 73*a*, the airtight space between the head 31 and the cap 71 goes to negative pressure, and the ink and foreign matter are suctioned from the nozzle Nz.

Also, for example, when ink is not discharged from the head 31 over a relatively long time such as when the printer 1 power is off, during waiting for a print job or the like, it is also possible to move the head group 32 to the home position HP, to adhere the cap 71 to each head 31, and to seal the nozzles Nz. By doing that, it is possible to inhibit evaporation of ink from the nozzle Nz and mixing in of foreign matter.

Also, with this embodiment, during defective nozzle testing, during the head 31 cleaning process, and during the flushing operation, ink is discharged from the nozzle Nz toward the same cap 71, but the invention is not limited to this. For example, separate from the cap 71 used with the cleaning process, it is also possible to provide a separate flushing box which receives ink discharged from the nozzle Nz with the flushing operation. Also, it is possible to seal the nozzle rows provided on a plurality of heads 31 using one cap.

Ink Replenishment Unit 80

FIG. 4 is an explanatory drawing of the ink replenishment unit 80 for white ink. The ink replenishment unit 80 is an item for replenishing ink to the head 31, and is provided for each color of ink. Here, a detailed description of the ink replenishment unit 80 for white ink (first ink) will be given. As shown in FIG. 4, the ink replenishment unit 80 for white ink (hereafter, also simply called ink replenishment unit) has a cartridge IC for storing white ink, a sub tank T1 (first ink reservoir unit), a temporary tank T2, an upstream tube 81, four supply tubes 82 (821 to 824) (first ink supply paths), four branch tubes 83 (831 to 834), a cartridge valve Va, four sub tank valves Vb (Vb1 to Vb4), four temporary tank valves Vc (Vc1 to Vc4), four intermediate valves Vd (Vd1 to Vd4), four head side valves Ve (Ve1 to Ve4), a first upstream pump Pa1 (stirring unit), a second upstream pump Pa2 (stirring unit), and a downstream pump Pb (stirring unit). Each tube becomes a white ink flow path (passage), and each valve opens or closes the flow of white ink.

The cartridge IC is an item for storing white ink, and is constituted to be able to be attached and detached with the printer 1 main unit. The sub tank T1 is an item for storing the white ink supplied from the cartridge IC before it is supplied to the head group 32, and is constituted so as to be fixed on the printer 1 interior, and to be able to be attached and detached from the printer 1 main unit. The temporary tank T2 is an item for temporarily storing white ink supplied from the sub tank T1.

The cartridge IC and the sub tank T1 are in communication via the upstream tube 81, and the cartridge valve Va is provided midway in the upstream tube 81. Also, provided in the sub tank T1 is a sensor (not illustrated) that detects when the ink volume inside the tank is less than a threshold value. When the controller 60 receives a signal from that sensor, it opens the cartridge valve Va that was closed, and has white ink flow into the sub tank T1 from the cartridge IC. Because of that, white ink of a volume of the threshold value or greater is always stored in the sub tank T1.

Four supply tubes 821 to 824 are connected to the sub tank T1, and the sub tank T1 is in communication respectively with the four head groups 32 (1) to 32 (4) via one supply tube 82. For example, the sub tank T1 and the first head group 32 (1) are in communication via the first supply tube 821, and the sub tank T1 and the second head group 32 (2) are in communication via the second supply tube 822. Then, when the white ink inside the head 31 is consumed, the white ink flows into the inside of the head 31 through the supply tubes 82 from the sub tank T1.

The temporary tank T2 is in communication with the sub tank T1 via the four supply tubes 821 to 824 connected to the sub tank T1, and the four branch tubes 831 to 834 branched respectively from the four supply tubes 821 to 824. In more detail, the branch tubes 83 are connected to the supply tubes 82 by the connectors C provided midway in each supply tube 82, and the supply tubes 82 and the branch tubes 83 are in communication. Also, the four supply tubes 821 to 824 are respectively connected to the sub tank T1 via the sub tank valves Vb1 to Vb4, and the four branch tubes 831 to 834 are respectively connected to the temporary tank T2 via the temporary valves Vc1 to Vc4.

Then, the first upstream pump Pa1 is provided midway in the first and fourth branch tubes 831 and 834, and the second upstream pump Pa2 is provided midway in the second and third branch tubes 832 and 833. The first upstream pump Pa1 sends ink in the direction moving ink from the sub tank T1 to the temporary tank T2, and the second upstream pump Pa2 sends ink in the direction moving the ink from the temporary tank T2 to the sub tank T1.

The sub tank T1 and the temporary tank T2 have flexibility, are formed in a bag shape using polyethylene resin, for example, or are formed in a bag shape using another resin having flexibility, or a metal such as silicon, aluminum or the like. Because of that, the sub tank T1 and the temporary tank T2 bend according to the housed ink volume, expand in accordance with ink filling the interior, contract in accordance with ink flowing out to the outside and the like, and can be flexibly deformed while keeping a certain amount of rigidity. Therefore, it is possible to deform until the state when the sub tank T1 and the temporary tank T2 are crushed with suction using the pump, and to flow out all of the white ink and air inside the sub tank T1 and the temporary tank T2.

Also, the bypass tubes 84 are connected by the connectors C to the supply tubes 82 at a position further downstream in the ink supply direction than the connecting part of the supply tubes 82 and the branch tubes 83. The four bypass tubes 841 to 844 are placed across mutually different supply tubes 82. In specific terms, the second supply tube 822 is connected to (in communication with) the first supply tube 821 via the first bypass tube 841, the third supply tube 823 is connected to (in communication with) the second supply tube 822 via the second bypass tube 842, the fourth supply tube 824 is connected to (in communication with) the third supply tube 823 via the third bypass tube 843, and the first supply tube 821 is connected to (in communication with) the fourth supply tube 824 via the fourth bypass tube 844.

The second bypass tube 842 and the fourth bypass tube 844 are provided at positions nearer to the sub tank T1 than the head group 32, and the first bypass tube 841 and the third bypass tube 843 are provided at positions nearer to the head group 32 than the sub tank T1. Also, because the sub tank T1 and the head group 32 are arranged at separated positions, the four supply tubes 821 to 824 become long tubes. Because of that, the supply tubes 821 to 824 between the second and fourth bypass tubes 842 and 844 and the first and third bypass tubes 841 and 843 are housed inside a Cableveyor (registered trademark) 85.

Then, the downstream pump Pb that feeds the ink inside the first supply tube 821 to the fourth supply tube 824 is provided midway in the fourth bypass tube 844. Also, interim valves Vd1 to Vd4 are provided at positions further downstream in the ink supply direction than the connecting part of the supply tube 82 and the branch tube 83, being midway in each of the supply tubes 821 to 824, and at positions further upstream than the connecting part of the supply tube 82 and the bypass tube 84. Also, head side valves Ve1 to Ve4 are provided at positions further upstream than the head group 32, being midway in each of the supply tubes 821 to 824, and positions further downstream in the ink supply direction than the connecting part of the supply tubes 82 and the bypass tubes 84.

The description above is the constitution of the ink replenishment unit 80 of the white ink. Since other colored inks (second inks) are not sedimentary inks, the ink replenishment unit 80 of the other colored inks has a typical constitution that is equipped with a sub tank for storing the other colored ink (second ink reservoir unit), a plurality of supply tubes (second ink supply paths) for supplying ink from the sub tank to the head and the like, but does not have the temporary tank T2, the branch tubes 83, the bypass tubes 84, the pumps Pa1, Pa2, Pb and the like. With the ink replenishment unit 80 of FIG. 4, the sub tank T1 is provided between the cartridge IC and the head group 32, but the invention is not limited to this, and for example, it is also possible to constitute it so that ink is replenished directly from the cartridge IC to the head group 32. Also, with the ink replenishment unit 80 in FIG. 4, ink is replenished from one supply tube 82 to one head group 32, and four supply tubes 82 are connected to the one head group 32, but the invention is not limited to this, and for example, it is also possible to constitute it such that the sub tank T1 and the head group 32 are connected by one or two supply tubes 82.

Stirring Process

The white ink used with the printer 1 of this embodiment is "sedimentary ink" for which the coloring material precipitates more easily than other color inks. Because of that, when the white ink is retained over a long period inside the tank in which the ink is stored, or the tube and the head 31 that are the flow path of the ink, the coloring material of the white ink precipitates. When that happens, the white ink concentration becomes uneven, and the nozzles Nz become clogged by the precipitated and collected coloring material. As a result, the image quality of the printed image is degraded. In light of that, with the printer 1 of this embodiment, by stirring the white ink inside the ink replenishment unit 80, the white ink coloring material sedimentation is eliminated (coloring material is dispersed), and printer 1 maintenance is performed.

In specific terms, as shown in FIG. 4, there is a division into an "upstream stirring area" which is a closed flow path formed by closing the cartridge valve Va and the intermediate valve Vd, and a "downstream stirring area" which is a closed flow path formed by closing the intermediate valve Vd and the head side valve Ve, and the white ink stirring process is executed. Following, the stirring process of each area will be described.

Downstream Stirring Area

In the normal time other than during the stirring process (e.g. during the printing operation or the like), the intermediate valve Vd and the head side valve Ve are open, and the downstream pump Pb is stopped. Because of that, when executing the stirring process in the downstream stirring area, the controller 60 closes the four intermediate valves Vd1 to Vd4 and the four head side valves Ve1 to Ve4. As a result, as shown in FIG. 4, closed flow paths (circulation paths) are formed constituted by the four supply tubes 821 to 824 (a portion) and the four bypass tubes 841 to 844.

Then, when the controller 60 drives the downstream pump Pb, the white ink is circulated inside the closed flow path in the direction in which the white ink inside the first supply tube 821 flows via the fourth bypass tube 844 to the fourth supply tube 824. As a result, the white ink that exists inside the supply tube 82 and the bypass tube 84 between the intermediate valve Vd and the head side valve Ve is stirred, and it is possible to eliminate the white ink coloring material sedimentation.

In this way, by having the four bypass tubes 841 to 844 (bypass paths) extended between mutually different supply tubes 821 to 824, it is possible to circulate the white ink respectively retained inside the four supply tubes 821 to 824 using one downstream pump Pb.

Upstream Stirring Area

Figure 5A:
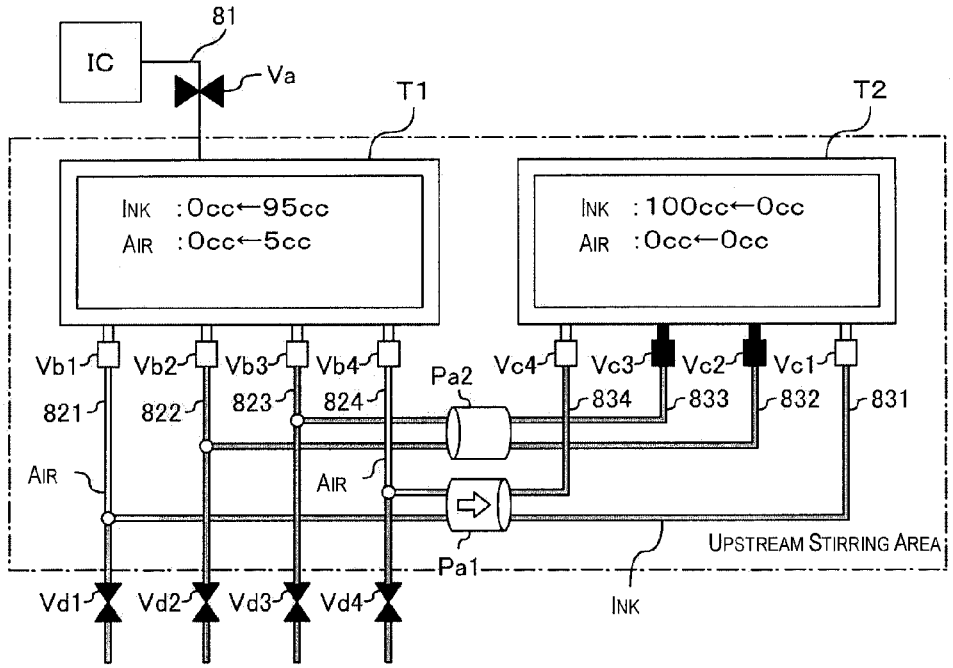
FIG. 5A is an explanatory drawing of the stirring process with the upstream stirring area.

FIG. 5A through FIG. 5F are explanatory drawings of the stirring process in the upstream stirring area. In the normal times other than during the stirring process (e.g. during the printing operation or the like), the intermediate valve Vd is open, and the first upstream pump Pa1 and the second upstream pump Pa2 are stopped. Because of that, when executing the stirring process in the upstream stirring area, first, if the cartridge valve Va is opened, the controller 60 closes it, and closes the four intermediate valves Vd1 to Vd4. Having done that, as shown in FIG. 5A, a closed flow path constituted by the upstream tube 81 (one portion), the sub tank T1, the temporary tank T2, the four supply tubes 821 to 824 (one portion), and the four branch tubes 831 to 834 is formed. In that state, by moving the white ink back and forth (circulating) between the sub tank T1 and the temporary tank T2, the white ink inside the sub tank T1 and the supply tubes 82 is stirred, and it is possible to eliminate sedimentation of the coloring material of the white ink inside the closed flow path.

However, when white ink is retained over a long period inside the cartridge IC, the white ink coloring material precipitates. However, the cartridge IC is constituted to be able to be attached and detached with the printer 1 main unit. Because of that, by the user removing the cartridge IC from the printer 1 and shaking it up and down, the white ink inside the cartridge IC is stirred, and it is possible to eliminate the white ink coloring material sedimentation. However, after stirring the white ink inside the cartridge IC, when the user mounts the cartridge IC in the printer 1, there are cases when air (air bubbles) penetrate into the sub tank T1 from the cartridge IC. In light of that, hereafter, an example of when together with the ink, air mixes into the sub tank T1 (e.g. when 95 cc of ink and 5 cc of air are mixed in) will be described. The state is without ink or air housed (hollow state) in the temporary tank T2, and the state is with ink filled in the supply tubes 82 and the branch tubes 83.

First, as shown in FIG. 5A, in a state with the cartridge valve Va and the intermediate valve Vd closed, the controller 60 sets a state whereby the second and third temporary tank valves Vc2 and Vc3 are closed, and the first and fourth temporary valves Vc1 and Vc4 and the sub tank valves Vb1 to Vb4 are open. Then, the controller 60 drives only the first upstream pump Pa1, and moves white ink from the sub tank T1 to the temporary tank T2. At this time, the white ink flows from the sub tank T1 to the temporary tank T2 through the region of the first supply tube 821 between from the connecting part of the first supply tube 821 and the first branch tube 831 to the first sub tank valve Vb1, the first branch tube 831, the region of the fourth supply tube 824 between from the connecting part of the fourth supply tube 824 and the fourth branch tube 834 to the fourth sub tank valve Vb4, and the fourth branch tube 834 (hereafter collectively referred to as the "outward path").

Also, at this time, the controller 60 drives the first upstream pump Pa1 until the sub tank T1 reaches a crushed state, and all the air is flowed out after all the ink has been flowed out from the sub tank T1. As a result, the sub tank T1 is in a hollow state (both ink and air are 0 cc), the temporary tank T2 is filled with ink filled in the outward path (e.g. 10 cc) and ink flowed out from the sub tank T1 (e.g. 90 cc), and the outward path is filled with the ink (e.g. 5 cc) and air (e.g. 5 cc) that finally flowed out from the sub tank T1.

Figure 5B:
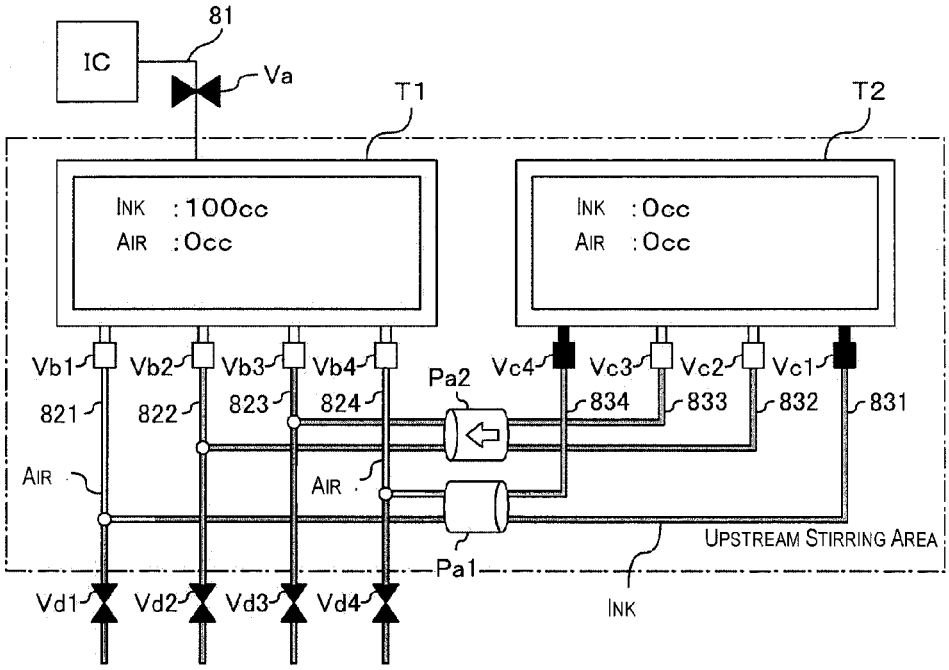
FIG. 5B is an explanatory drawing of the stirring process with the upstream stirring area.
Figure 5C:
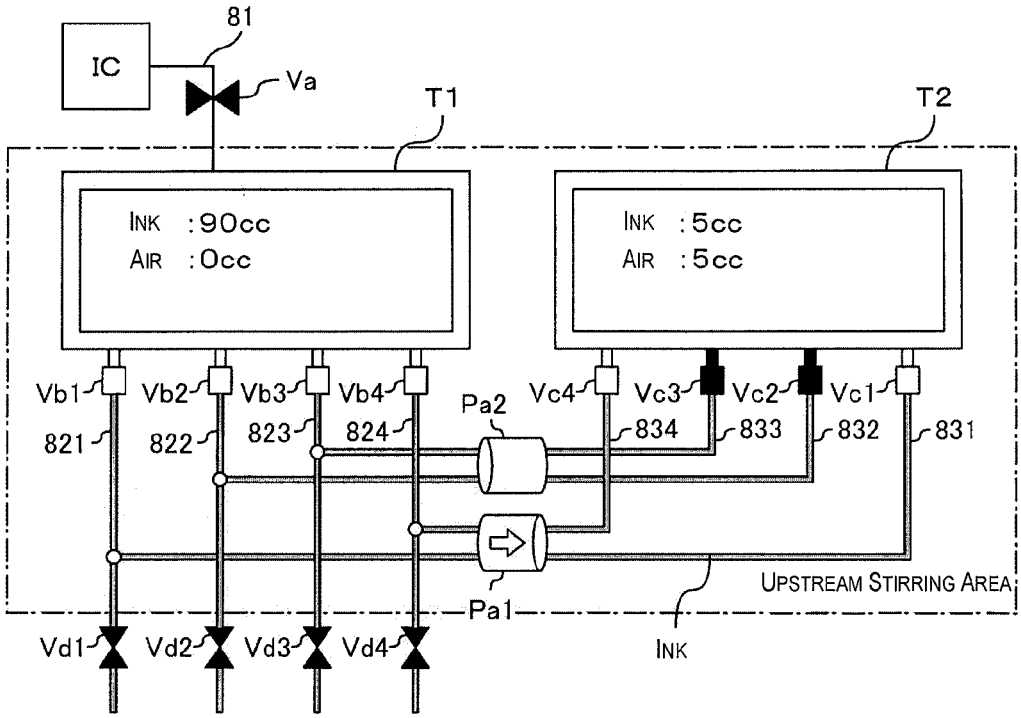
FIG. 5C is an explanatory drawing of the stirring process with the upstream stirring area.

Next, as shown in FIG. 5B, the controller 60 opens the second and third temporary tank valves Vc2 and Vc3, closes the first and fourth temporary tank valves Vc1 and Vc4, and drives only the second upstream pump Pa2 until the temporary tank T2 is in a crushed state. At this time, white ink flows from the temporary tank T2 to the sub tank T1 through the second branch tube 832, the region of the second supply tube 822 between from the connecting point of the second supply tube 822 and the second branch tube 832 to the second sub tank valve Vb2, the third branch tube 833, and the region of the third supply tube 823 between from the connecting part of the third supply tube 823 and the third branch tube 833 to the third sub tank valve Vb3 (hereafter collectively referred to as the "return path"). As a result, the temporary tank T2 is in a hollow state, and the sub tank T1 is filled with the ink filled in the return path (e.g. 10 cc) and the ink that flowed out from the temporary tank T2 (e.g. 90 cc), and the return path is filled with ink (e.g. 10 cc) that finally flowed out from the temporary tank T2.

In this way, by moving the white ink back and forth between the sub tank T1 and the temporary tank T2, the white ink inside the upstream stirring area is stirred, and it is possible to eliminate the white ink coloring material sedimentation. However, air remains in the first and fourth supply tubes 821 and 824. When the stirring process ends in this state, and the next operation such as printing or the like is executed, when white ink is replenished from the sub tank T1 to the head group 32, the air inside the first and fourth supply tubes 821 and 824 flows to the head group 32. When air (air bubbles) mix into inside the head 31, it is not possible to discharge the ink properly from the nozzles Nz, and image quality degradation of the printed image occurs. Also, replenishing of the ink is obstructed by the air inside the head 31.

Because of that, the processes shown in FIG. 5C to FIG. 5F can continue to be executed. With FIG. 5C, the controller 60 opens the first and fourth temporary tank valves Vc1 and Vc4, closes the second and third temporary tank valves Vc2 and Vc3, and drives only the first upstream pump Pa1. At this time, only a portion (e.g. 10 cc) of the white ink inside the sub tank T1 flows. As a result, the ink (e.g. 5 cc) and air (e.g. 5 cc) filled in the outward path flows into the temporary tank T2, and the outward path is filled with white ink that flows out from the sub tank T1. At this time, ink of the volume filled in the region of the first and fourth supply tubes 821 and 824 of the outward path is made to flow at least from the sub tank T1. By doing that, it is possible to push out the air from the first and fourth supply tubes 821 and 824, and possible to prevent air from flowing into the head 31 when replenishing ink. Also, even if air remains in the branch tubes 83, it cannot flow to inside the head 31, so there is no problem.

Figure 5D:
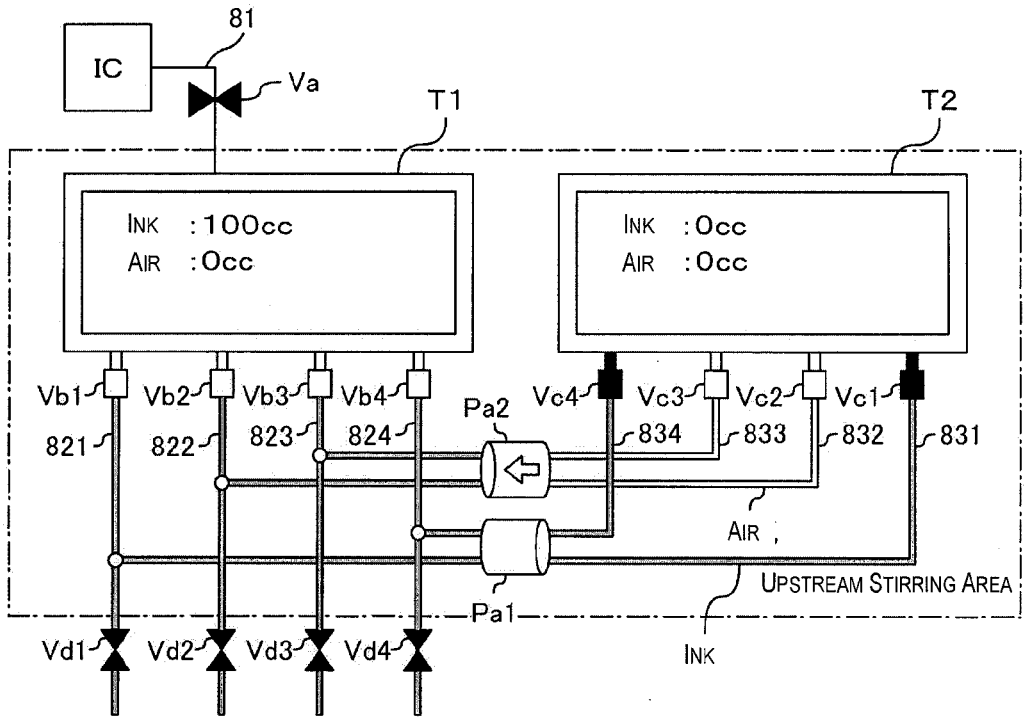
FIG. 5D is an explanatory drawing of the stirring process with the upstream stirring area.

Next, as shown in FIG. 5D, the controller 60 opens the second and third temporary tank valve Vc2 and Vc3, closes the first and fourth temporary tank valves Vc1 and Vc, and drives only the second upstream pump Pa2 until reaching a state with the temporary tank T2 crushed. As a result, the temporary tank T2 is in a hollow state, the ink filled in the return path (e.g. 10 cc) flows to the sub tank T1, and the ink (e.g. 5 cc) and air (e.g. 5 cc) filled in the temporary tank T2 flow to the return path.

Figure 5E:
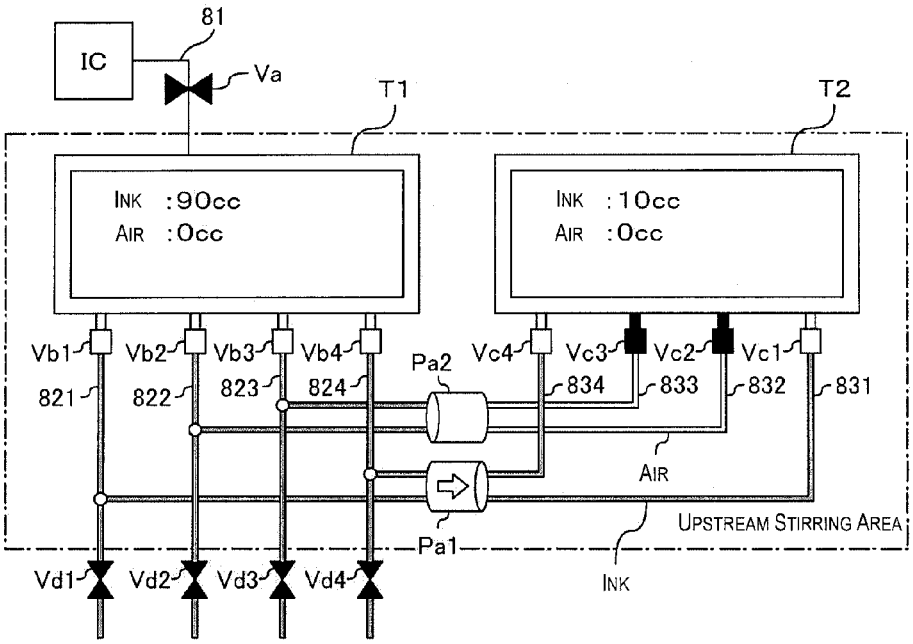
FIG. 5E is an explanatory drawing of the stirring process with the upstream stirring area.

Next, as shown in FIG. 5E, the controller 60 opens the first and fourth temporary tank valves Vc1 and Vc4, closes the second and third temporary tank valves Vc2 and Vc3, drives only the first upstream pump Pa1, and flows a portion of the ink (e.g. 10 cc) of the ink inside the sub tank T1 to the outward path. As a result, the ink filled in the outward path (e.g. 10 cc) flows to the temporary tank T2, and the return path is filled with the ink and air that finally flowed out from the temporary tank T2.

Figure 5F:
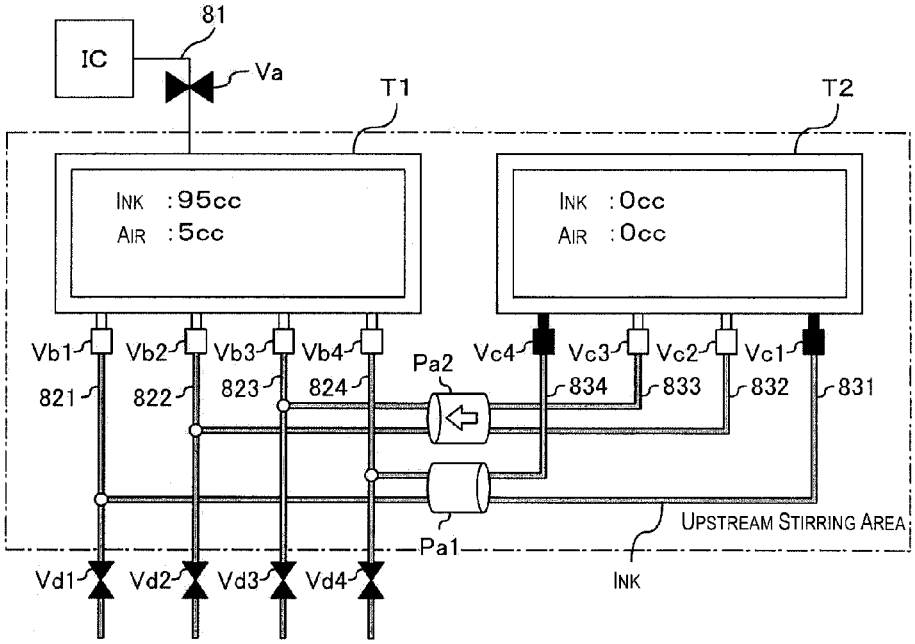
FIG. 5F is an explanatory drawing of the stirring process with the upstream stirring area.

Finally, as shown in FIG. 5F, the controller 60 opens the second and third temporary tank valves Vc2 and Vc3, closes the first and fourth temporary tank valves Vc1 and Vc4, and drives only the second upstream pump Pa2 until the temporary tank T2 is in a crushed state. As a result, this is the same state as before execution of the stirring process (FIG. 5A). Specifically, the ink (5 cc) and air (5 cc) that filled the return path flows to the sub tank T1, the temporary tank T2 is in a hollow state, and the supply tubes 82 and the branch tubes 83 are filled with ink. Therefore, when ink is replenished from the sub tank T1 to the head group 32, it is possible to prevent the air from flowing into the head 31. Also, because the white ink moved back and forth between the sub tank T1 and the temporary tank T2, the white ink inside the upstream stirring area (especially the white ink inside the sub tank T1) is stirred. It is possible to eliminate the white ink coloring material sedimentation.

As described above, by circulating and stirring the white ink inside the upstream stirring area and the downstream stirring area, it is possible to eliminate the white ink coloring material sedimentation. Therefore, it is possible to use the white ink inside the region further upstream than the head side valve Ve for printing or the like without ejecting it (discarding), so it is possible to prevent white ink from being consumed wastefully. In other words, it is possible to inhibit the problems due to white ink retention.

Also, as described previously, the sub tank T1 and the head group 32 are arranged at separated positions, and the supply tube 82 is long. Because of that, by stirring the white ink divided into the upstream stirring area and the downstream stirring area, it is possible to shorten the stirring process time, and it is possible to use a pump with a small power source. However, the invention is not limited to this, and it is also possible to have the white ink stirred with the flow path between the cartridge valve Va and the head side valve Ve as one closed flow path (circulation flow path). Also, it is also possible to make it so that only the white ink inside the upstream region in the ink supply direction of the plurality of supply tubes 82 is stirred, without stirring the white ink inside the sub tank T1.

Unstirred Area Processing

Figure 6:
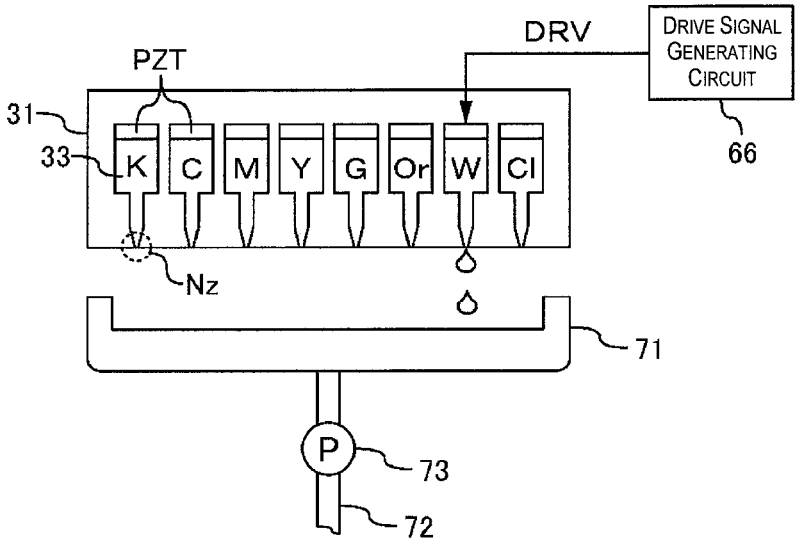
FIG. 6 is an explanatory drawing of the processing of the white ink existing in the unstirred area.

FIG. 6 is an explanatory drawing of the processing of the white ink that exists in the unstirred area. The white ink inside the upstream stirring area and the downstream stirring area is stirred using the stirring process described previously (FIG. 4 and FIG. 5). However, of the supply tubes 82, the white ink that exists inside the region further downstream than the head side valve Ve, and inside the head 31 (hereafter collectively referred to as the "unstirred area") is not stirred, the white ink inside the unstirred area is retained for a long time, and the coloring material precipitates. Because of that, when the printing operation is executed with the previously described stirring process simply ended, white ink that was retained for a long time is used for printing, and the image quality of the printed image is degraded.

In light of that, the white ink inside the unstirred area after the end of the previously described stirring process is ejected (discarded). By doing that, the white ink retained for a long time being used for printing and degrading the image quality of the printed image can be prevented.

Here, to eject white ink of the unstirred area, the cleaning process of the head 31 shown in FIG. 3 is provisionally executed. With the head 31 cleaning process using the suction pump 73, all the nozzle rows provided on one head 31 are covered by one cap 71, so ink is suctioned by the suction pump 73 from all the nozzle rows provided on the head 31. In other words, when the cleaning process of the head 31 is executed by the suction pump 73 to eject the white ink of the unstirred area, other colored ink that is not sedimentary ink is ejected simultaneously, so ink for which problems do not occur due to ink retention is consumed wastefully.

In light of that, when white ink has been retained over a long period, specifically, after a prescribed time has elapsed since the previous stirring process, the controller 60 (control unit) of this embodiment again executes the stirring process, and after that stirring process, using a flushing operation, ejects only the white ink of the unstirred area from the head 31 (nozzles Nz). Specifically, the white ink retained for a long time (or white ink for which that is a concern) is ejected, and ink for which problems do not occur due to retention is not ejected from the head 31. By doing that, the ink for which problems do not occur due to retention for a long time (a prescribed time or greater) (specifically, ink that is not sedimentary ink) is prevented from being consumed wastefully, and it is possible to prevent white ink of the unstirred area from being used for operations such as printing or the like. Thus, it is possible to prevent image degradation of the printed image due to ink with uneven concentration, and clogging of the nozzles Nz due to aggregated coloring material, and it is possible to inhibit problems due to retention of sedimentary ink.

Here, as shown in FIG. 6, for each nozzle Nz, the head 31 of the present invention has a pressure chamber 33 in communication with that nozzle Nz and filled with ink, and a piezo element PZT (drive element) for changing the pressure inside the corresponding pressure chamber 33. Then, when the discharge waveform generated by the drive signal DRV output from the drive signal generating circuit 66 (controller 60) is applied to the piezo element PZT, the piezo element PZT expands and contracts in the vertical direction according to the electric potential of that drive waveform. As a result, the pressure chamber 33 expands or contracts in correspondence to that piezo element PZT, pressure changes of the ink inside the pressure chamber 33 occur, and ink droplets are discharged from the nozzle Nz. The ink discharge method from the nozzles Nz is not limited to this, and for example can be a thermal method by which air bubbles are generated inside the nozzle using a heating element (drive element), and ink drops are discharged from the nozzle using those air bubbles.

Then, to execute the flushing operation after the stirring process, the controller 60 has each head 31 face opposite the cap 71. Then, the controller 60 performs control so that a discharge waveform generated by the drive signal DRV for flushing is applied to the piezo elements PZT corresponding to the nozzles Nz discharging the white ink, and a discharge waveform generated by the drive signal DRV for flushing is not applied to the piezo elements PZT corresponding to the nozzles Nz discharging ink other than the white ink (sedimentary ink). As a result, white ink is discharged from only the nozzles Nz that belong to the white nozzle row W, and ink is not discharged from nozzles Nz belonging to other nozzle rows. Then, the controller 60 continues the flushing operation until ink of the white ink volume existing in the unstirred area is discharged from the white ink nozzle row Nz.

Printer 1 Process

Figure 7:
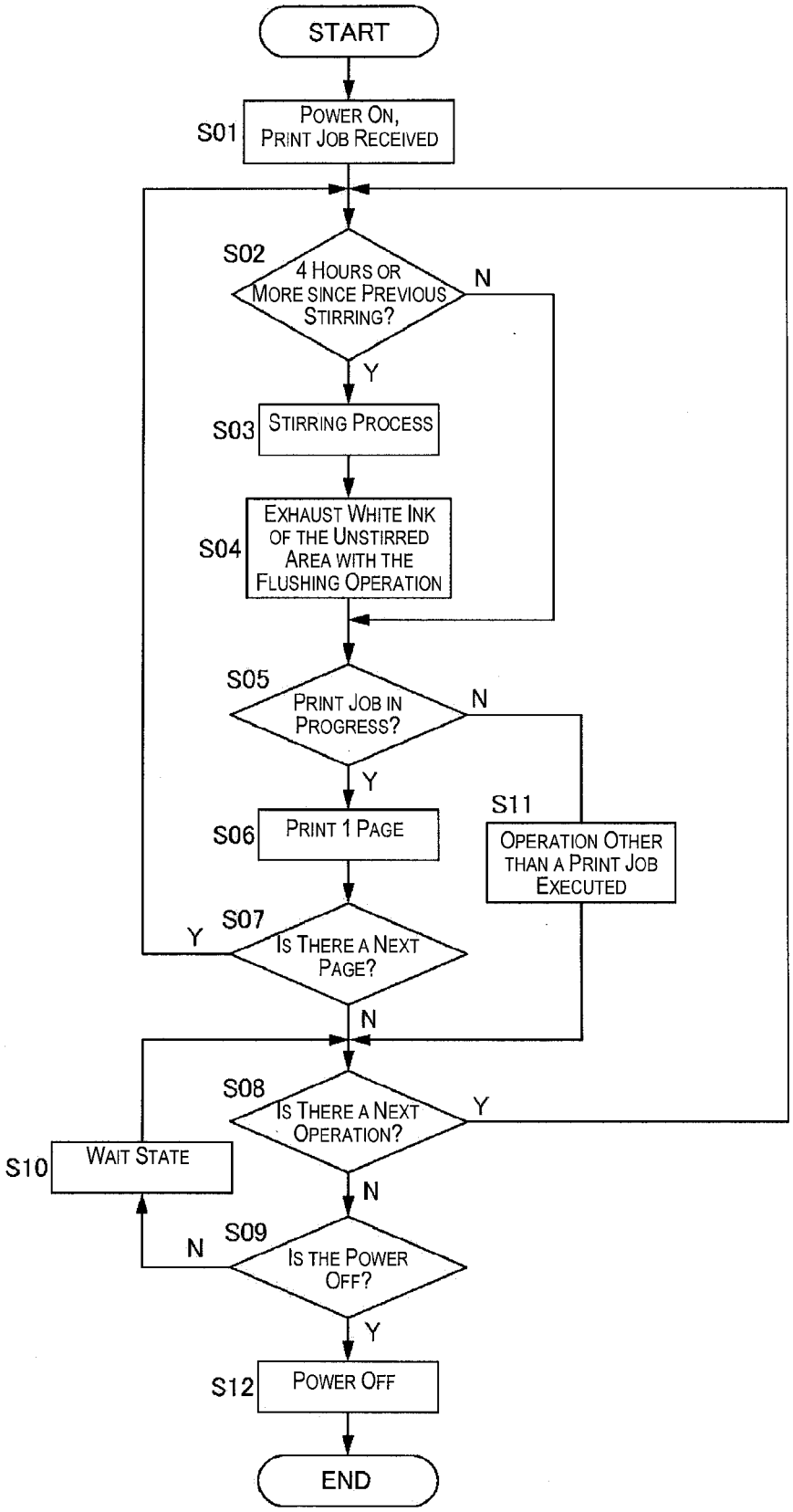
FIG. 7 is a flow chart showing the printer process.

FIG. 7 is a flow chart showing the process of the printer 1. The printer 1 of this embodiment, during the period that the power is on, executes the white ink stirring process in the upstream stirring area and the downstream stirring area basically every four hours, after which the white ink of the unstirred area is ejected using the flushing operation. However, when processing of the print job is not done when four hours have elapsed since the previous stirring process, the stirring process is not executed, and the stirring process is executed before starting the next operation. Also, during the period that the power is off, the stirring process is not executed even when four hours have elapsed since the previous stirring process.

With this embodiment, the stirring process is executed after four hours (prescribed time) have elapsed since the previous stirring process, but the invention is not limited to this. Specifically, the prescribed time can be shorter or longer than four hours, and it is also possible to derive the time for which problems will not occur even if the white ink is retained inside the head 31 or the like through testing, for example. Also, with this embodiment, regardless of the white ink discharge state, the stirring process is executed basically every four hours (prescribed time), but the invention is not limited to this. For example, it is possible to change the prescribed time according to the white ink discharge state, such as by making the gap between stirring processes longer when discharging of white ink is continuous.

Hereafter, the process of printer 1 following the flow of FIG. 7 will be described. First, after the printer 1 power is turned on, when a print job is received (S01), the controller 60 judges whether or not four hours or more have elapsed since the previous white ink stirring process (S02). The time from the previous stirring process can be managed using the timer 65 that the controller 60 has. Then, when four or more hours have elapsed since the previous stirring process (S02→Y), the controller 60 executes the stirring process of the white ink in the upstream stirring area and the downstream stirring area (S03), and ejects the white ink of the unstirred area with a flushing operation. After that, the received print job is started (S05→Y), and first, one page (one printing area A) of the image is printed (S06). By doing that, it is possible to execute printing without using white ink for which problems occur due to retention (or for which that is a concern), and it is possible to inhibit image quality degradation of printed images. Meanwhile, when four hours or more have not elapsed since the previous stirring process (S02→N), the controller 60 starts the received printing job without executing the stirring process.

Also, during print job processing (S07→Y), each time one page of image is printed, the controller 60 confirms whether or not four hours or more have elapsed since the previous stirring process (S02). Because of that, the stirring process is executed even when the print job processing is midway in progress. In other words, when the print job process is in progress, when four hours (the prescribed time) or more elapse since the previous stirring process, the stirring process is executed during that print job process. By doing that, it is possible to more reliably prevent white ink that was retained for four hours since the previous stirring process (or white ink for which there is a risk it was retained) from being used for printing. However, the invention is not limited to this, and for example, it is also possible to confirm the elapsed time since the previous stirring process for each print job.

Then, when the print job ends (S07→N), the controller 60 confirms the presence or absence of the next operation, for example the next print job, defective nozzle test, or head 31 cleaning process. The defective nozzle test and the head 31 cleaning process can be made to be executed as appropriate according to the time from the previous print job, or the number of print jobs or number of printed pages or the like executed after the previous test or cleaning process. Then, when there is a next operation (S08→Y), before starting that operation, the controller 60 judges whether or not four or more hours have elapsed since the previous stirring process (S02), and when four or more hours have elapsed, after executing the stirring process or the like (S03, S04), executes the next operation (S11). Meanwhile, when there is no next operation (S08→N), or when the power is not turned off (S09→N), the printer 1 goes to a wait state (S10). In this wait state, even when four hours or more elapse since the previous stirring process, the wait state continues without executing the stirring process.

In other words, when a print job is not being processed, and four hours (the prescribed time) have elapsed since the previous stirring process, the controller 60 executes the stirring process before starting the next operation (preferably immediately before). In the wait state when an operation such as the print job or the like is not executed, problems do not occur even if the white ink is retained and the coloring material precipitates. Because of that, when in the wait state, by making it so that wasteful stirring processing is not executed even when four hours or more have elapsed since the previous stirring process, it is possible to inhibit consumption of white ink due to ejecting of white ink of the unstirred area. The process described above is repeated until the printer 1 power is turned off (S12).

MODIFICATION EXAMPLE

Unstirred Area Process

With the embodiment described above, after the white ink stirring process, only the white ink of the unstirred area is ejected using the flushing process, but the invention is not limited to this. For example, with a plurality of white nozzle rows provided on the head 31, it is also possible to suction white ink of the unstirred area from only the plurality of white nozzle rows using the suction pump provided on the cap when it is possible to form a sealed space with one cap covering only the plurality of white nozzle rows.

Maintenance Fluid Filling

For example, when the power is off or during a print job that does not use white ink, it is also possible to remove the white ink from the unstirred area, and to fill the unstirred area instead with maintenance fluid or clear ink. Maintenance fluid and clear ink are inks for which components do not precipitate even with long term retention. Because of that, with the ink replenishment unit 80 (FIG. 4), it is sufficient to have the constitution such that a tube that supplies maintenance fluid or the like is connected to the region of the supply tube 82 further downstream than the head side valve Ve. Then, in a state with the cap 71 (FIG. 3) adhered to the head 31, the head side valve Ve is closed, and in a state for which maintenance fluid or the like can be supplied, the suction pump 73 is driven. By doing that, the white ink of the unstirred area is suctioned, and instead, maintenance fluid or the like is filled in the unstirred area. The reverse process is executed when use of the white ink is started again. By doing that, it is possible to prevent the nozzles Nz from becoming clogged by the white ink hardening due to leaving the white ink standing for a long time. Also, even if the head 31 cleaning process (FIG. 3) is executed during a print job which does not use white ink, if the unstirred area is filled with maintenance fluid or the like, maintenance fluid or the like is suctioned instead of white ink, so it is possible to inhibit consumption of relatively expensive white ink.

Printer

Figure 8:
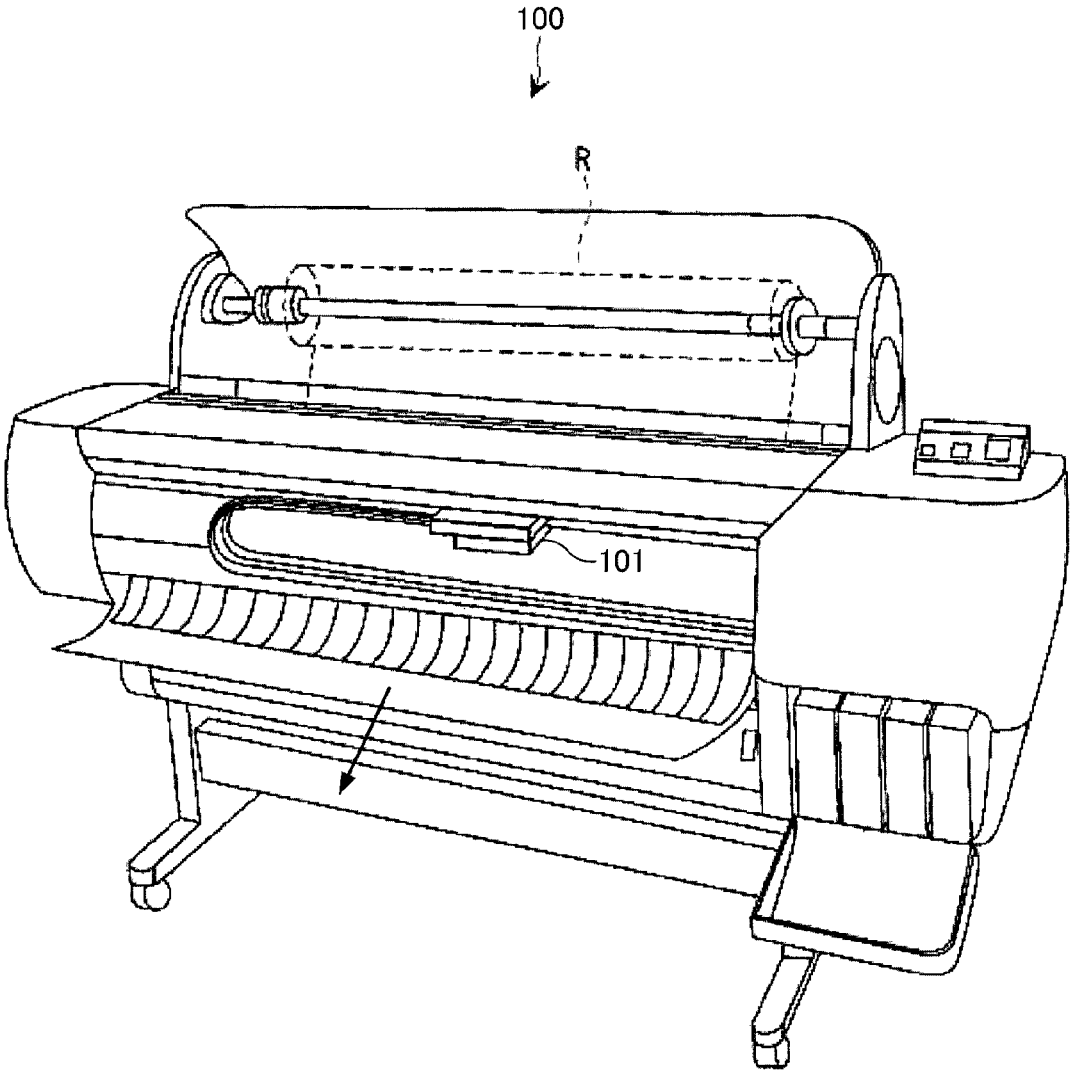
FIG. 8 is an explanatory drawing of the printer of a modification example.

FIG. 8 is an explanatory drawing of the printer 100 of a modification example. With the embodiment noted above (FIG. 1), an example of the printer 1 is shown for which, in relation to the region of the roll paper S conveyed to the printing area A, the operation of printing an image by having the head group 32 discharge ink while moving in the X direction (roll paper S conveyance direction) and having the head group 32 move in the Y direction (paper width direction), and the operation of conveying a new region of the roll paper S to the printing area A were repeated, but the invention is not limited to this. For example, as shown in FIG. 8, it is also possible to have the printer 100 that prints two dimensional images on roll paper R by repeating the operation of discharging ink while moving the head group 101 in the paper width direction of the roll paper R and the operation of conveying the roll paper R in the conveyance direction. Also, for example, it is possible to have a printer for which the head discharges ink toward the roll paper when the bottom of the head for which nozzles are aligned and fixed across a length of the paper width or greater of the roll paper passes through in the direction for which the roll paper is orthogonal to the paper width direction.

Sedimentary Ink

With the embodiment noted above, white ink was given as an example of sedimentary ink, but the invention is not limited to this. The sedimentary ink is acceptable as long as it is an ink such that when it is retained for a long time, the ink components precipitate, and examples include pigmented inks containing large particle pigments or heavy pigments, metallic inks containing metal pigments such as aluminum, silver or the like (ink that expresses a metallic sheen on the printed material), and the like.

Above, the embodiments noted above are items to make the present invention easy to understand, and are not to be interpreted as restricting the present invention. It goes without saying that the present invention can be modified and improved, and the equivalent items of the present invention are included therein without straying from its gist. For example, with the embodiment noted above, an embodiment with a printer 1 alone is shown as the printing device, but the invention is not limited to this, and it is also possible to have the printing device be a part of a compound apparatus such as a fax or scanner device, a copy device or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A maintenance method of a printing device, the maintenance method comprising:

executing an again stirring process of stirring a first ink that exists in an upstream region in a supply direction among a plurality of first ink supply paths of the printing device by a first stirring unit of the printing device after a prescribed time has elapsed from a previous stirring process, the printing device including a first ink reservoir unit configured and arranged to store the first ink with a first color, the first ink having sedimentary properties, a head provided with nozzles configured and arranged to discharge the first ink, the first ink supply paths each of which is configured and arranged to supply the first ink to the head from the first ink reservoir unit, a plurality of valves arranged in the first ink supply paths, respectively, each of the valves being arranged and configured to open or close flow of the first ink in each of the first ink supply paths, the first stirring unit configured and arranged to stir the first ink existing inside an upstream in the supply direction of the first ink supply paths relative to the valves, and a second stirring unit configured and arranged to stir the first ink existing inside a downstream in the supply direction of the first ink supply paths relative to the valves; and after executing the again stirring process, ejecting from the nozzles the first ink that is unstirred existing inside a region further downstream in the supply direction than the upstream region among the first ink supply paths, and inside the head.

2. A printing device comprising:

a first ink reservoir unit configured and arranged to store a first ink with a first color, the first ink having sedimentary properties;

a first head provided with nozzles configured and arranged to discharge the first ink, a plurality of first ink supply paths each of which is configured and arranged to supply the first ink to the first head from the first ink reservoir unit;

a plurality of valves arranged in the first ink supply paths, respectively, each of the valves being arranged and configured to open or close flow of the first ink in each of the first ink supply paths;

the first stirring unit configured and arranged to stir the first ink existing inside an upstream in a supply direction of the first ink supply paths relative to the valves;

a second stirring unit configured and arranged to stir the first ink existing inside a downstream in the supply direction of the first ink supply paths relative to the valves; and a control unit configured and arranged to execute again an again stirring process of the first ink after a prescribed time has elapsed from a previous stirring process of the first ink by the first stirring unit, and, after execution of that the again stirring process, to eject from the nozzles the first ink that is unstirred existing inside a region further downstream in the supply direction than the upstream region of the first ink supply paths, and inside the first head.

3. The printing device according to claim 2, wherein for each nozzle, the first head includes a pressure chamber in communication with the nozzle and filled with the first ink, and a drive element configured and arranged to change a pressure inside the pressure chamber, and the control unit, using a flushing operation that discharges the first ink from the nozzle by changing the pressure inside the pressure chamber by driving the drive element, is configured to eject the first ink that is unstirred from the nozzle after execution of the again stirring process.

4. The printing device according to claim 2, wherein during print job processing, when the prescribed time has elapsed from the previous stirring process of the first ink, the control unit is configured to execute the again stirring process of the first ink during the print job processing.

5. The printing device according to claim 2, wherein when not processing a print job, when the prescribed time has elapsed from the previous stirring process of the first ink, the control unit is configured to execute the again stirring process of the first ink before starting a next operation.

6. The printing device according to claim 2, further comprising:

a second head provided with nozzles configured and arranged to discharge a second ink of a different color from the first ink;

a second ink reservoir unit configured and arranged to store the second ink; and a plurality of second ink supply paths configured and arranged to supply the second ink to the second head from the second ink reservoir unit, wherein a plurality of the first ink supply paths are connected to the first ink reservoir unit, and a plurality of bypass paths are extended between mutually different ones of the first ink supply paths, and the first stirring unit is configured and arranged to stir the first ink by circulating the first ink inside a circulation path constituted by the plurality of the first ink supply paths and the plurality of the bypass paths.

7. The printing device according to claim 6, further comprising a temporary reservoir unit configured and arranged to store the first ink supplied from the first ink reservoir unit, and a plurality of branch paths respectively branched from the plurality of first ink supply paths and connected to the temporary reservoir unit, wherein the first stirring unit is configured and arranged to stir the first ink by returning the first ink inside the temporary reservoir unit to the first ink reservoir unit via the branch paths and the first ink supply paths after the first ink inside the first ink reservoir unit is supplied to the temporary reservoir unit via the first ink supply paths and the branch paths.

* * * * *